US008866112B2

(12) United States Patent
Mercado et al.

(10) Patent No.: US 8,866,112 B2
(45) Date of Patent: Oct. 21, 2014

(54) PROTECTIVE SHIELD FOR PROTECTING SKIN ON A DIGIT FROM UV RADIATION

(71) Applicants: Rochelle Rosemarie Mercado, Cremorne (AU); Fiona Lee Reeve, Dural (AU)

(72) Inventors: Rochelle Rosemarie Mercado, Cremorne (AU); Fiona Lee Reeve, Dural (AU)

( * ) Notice: Subject to any disclaimer, the term of this patent is extended or adjusted under 35 U.S.C. 154(b) by 0 days.

(21) Appl. No.: 13/923,554

(22) Filed: Jun. 21, 2013

(65) Prior Publication Data

US 2013/0341536 A1 Dec. 26, 2013

(30) Foreign Application Priority Data

Jun. 22, 2012 (AU) ..... 2012902641

(51) Int. Cl.
*A41D 13/06* (2006.01)
*A41D 13/08* (2006.01)

(52) U.S. Cl.
CPC ..... *A41D 13/087* (2013.01); *A41D 13/06* (2013.01); *A41D 2400/26* (2013.01)
USPC ..... 250/515.1; 250/505.1; 250/516.1

(58) Field of Classification Search
CPC ... A41D 13/087; A45D 29/18; A61N 5/0616; A61Q 3/02; B05D 3/067
USPC ..... 250/505.1, 515.1, 516.1
See application file for complete search history.

(56) References Cited

U.S. PATENT DOCUMENTS

| | | | | |
|---|---|---|---|---|
| 5,130,551 | A * | 7/1992 | Nafziger et al. | 250/492.1 |
| 2005/0199253 | A1 * | 9/2005 | Fiore et al. | 132/73 |
| 2009/0143842 | A1 * | 6/2009 | Cumbie et al. | 607/88 |
| 2013/0341536 | A1 * | 12/2013 | Mercado et al. | 250/516.1 |

FOREIGN PATENT DOCUMENTS

CA 2340209 A1 * 9/2002

OTHER PUBLICATIONS

"Nail Salon drying lights called skin cancer risk", CBC News, Mar. 6, 2012, www.cbc.ca/news/health/story/2012/03/06/nail-shellac-skin-cancer.html, 2 pages.
"The Truth About Shellac . . . ", Nails for Her Inc, Feb. 16, 2011, www.facebook.com/notes/nails-for-her-inc/the-thruth-about-shellac, 2 pages.

* cited by examiner

*Primary Examiner* — David A Vanore
(74) *Attorney, Agent, or Firm* — Merchant & Gould P.C.

(57) ABSTRACT

A protective shield is provided for protecting the skin on a digit, such as a finger or a toe of a person, from UV radiation. The protective shield includes a longitudinal shield body that extends from a first end to a second end of the shield body, the shield body being formed of a flexible UV resistant sheet material that is sized to substantially cover the skin on the back of the digit. The first end of the shield body has a notched portion for exposing the nail of the digit and also includes a means of securing the shield body to the digit, for example a gel or an adhesive tape.

17 Claims, 2 Drawing Sheets

PROTECTIVE SHIELD FOR PROTECTING SKIN ON A DIGIT FROM UV RADIATION

This application claims benefit of Serial No. 2012902641, filed 22 Jun. 2012 in Austalia and which application is incorporated herein by reference. To the extent appropriate, a claim of priority is made to each of the above disclosed applications.

FIELD

The present disclosure relates to UV radiation protection.

BACKGROUND

Decorating and protecting nails using nail polish is well known. The dry, hardened nail polish forms a protective layer on the nail.

A method of further hardening nail polish is to expose the nail polish to UV light during the drying process. The nail polish is typically applied by beauticians, and a drying booth having a UV lamp is used to provide the UV light.

However, using UV light to harden nail polish may also expose skin to UV light, increasing the risk of skin cancer.

OBJECT OF THE INVENTION

It is the object of the present invention to substantially overcome or at least ameliorate the above disadvantage.

SUMMARY OF THE INVENTION

In a first aspect, the present invention provides a protective shield for protecting skin on a digit of a person from UV radiation exposure, said protective shield comprising:

a shield body that extends longitudinally from a first end to a second end of said shield body, said shield body comprising an elongate flexible UV resistant sheet material sized to substantially cover the skin on the back of the digit, said first end having a notched portion for exposing the nail of the digit; and a securing means for securing said shield body to the digit.

Preferably, said shield body tapers from said second end to said first end.

Preferably, said notched portion comprises an arcuate cutout.

In one form, said securing means comprises a gel that is infused into the shield body.

In an alternate form, said securing means comprises adhesive tape.

In such an alternate form, said securing means includes two opposing strips of the adhesive tape that extend longitudinally along said shield body adjacent opposing sides of said shield body.

Preferably, the strips of adhesive tape extend along said shield body to said first end adjacent said notched portion.

Preferably, the flexible UV resistant sheet material comprises a non woven fabric.

Preferably, a moisturising and/or anti-aging agent is infused into said shield body.

In one form, said shield body is sized to cover a finger.

In another form, said shield body is sized to cover a toe.

Preferably, said shield body is sized to extend beyond the digit onto the adjoining appendage of the person.

In a second aspect, the present invention provides a method of protecting skin on one or more digits of a person from UV radiation exposure, said method including the steps of:

(a) locating said shield body defined above on a digit of the person, such that said notched portion aligns with the nail of the digit and said shield body extends along the digit; and (b) securing said shield body to the digit using said securing means.

Preferably, the method further comprises repeating steps (a) and (b) in relation to one or more further digits of the person.

Preferably, said shield bodies extend beyond the digit onto the adjoining appendage with said second ends of the shield bodies overlapping to form continuous protection on the appendage.

In one application, the digit is a finger and the appendage is a hand.

In another application, the digit is a toe and the appendage is a foot.

BRIEF DESCRIPTION OF THE DRAWINGS

A preferred embodiment of the present invention will now be described, by way of example only, with reference to the accompanying drawing, wherein.

DESCRIPTION OF EMBODIMENT

Figure 1:
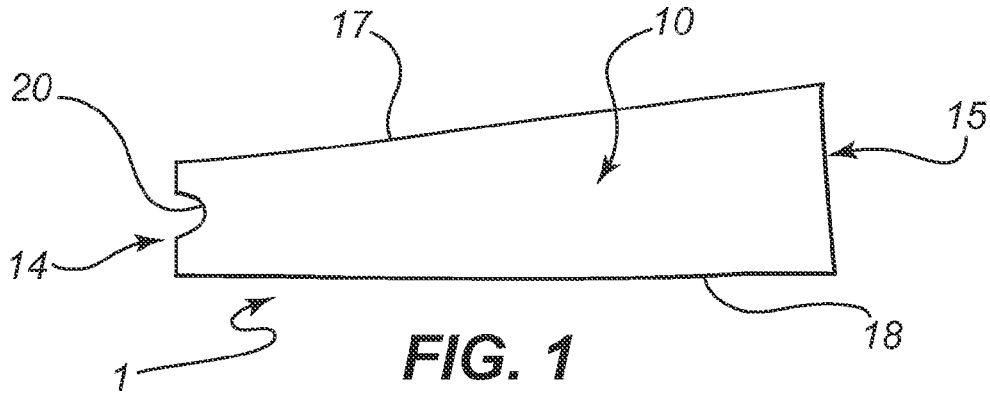
FIG. 1 is top view of an embodiment of a protective shield.
Figure 2:
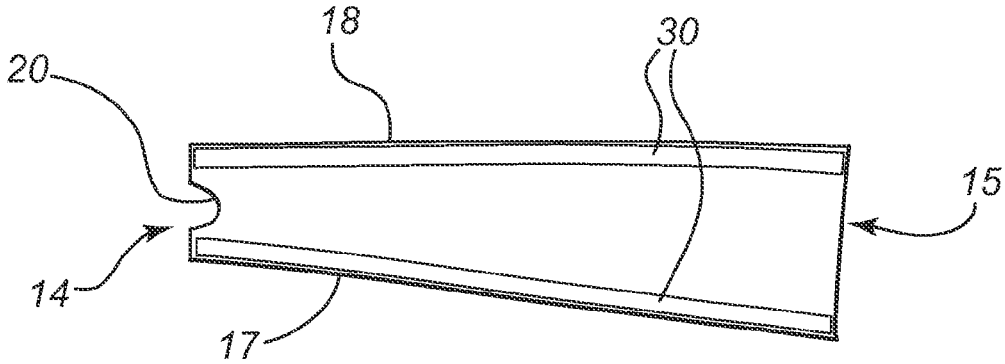
FIG. 2 is bottom view of the protective shield of FIG. 1.

A protective shield 1 for protecting skin on a digit of a person from UV radiation exposure is shown in FIGS. 1 and 2. The protective shield 1 comprises a shield body 10 and a securing means 30. The shield body 10 extends longitudinally from a first end 14 to a second end 15. The securing means 30 enables the shield body 10 to be secured to a digit of the person.

The shield body 10 is comprised of flexible UV resistant sheet material. Typically, the flexible UV resistant sheet material is a non woven fabric. Polypropylene and bamboo are suitable examples of non woven fabrics. Bamboo is particularly suitable as it is a natural product having a naturally occurring Ultraviolet Protection Factor (UPF) of about 15. A suitable weight of the bamboo would be 100 gsm. However, it is envisioned that various other materials may be used for the shield body 10 so long as it has sufficient UV protection properties and is flexible.

The first end 14 and the second end 15 of the shield body 10 have opposing sides 17 and 18 extending therebetween. The shield body 10 tapers from the second end 15 to the first end 14, such that the second end 15 has a greater width than the first end 14. In the example depicted, the shield body 10 is sized to cover the finger of the person, with the first end 14 approximately 3 cm in width and the second end 15 approximately 4.5 cm in width. The length of the shield body 10 depicted is approximately 16.5 cm, such that the shield body 10 extends along the finger onto the adjoining appendage, such as a hand, providing protection from UV radiation to the back of the hand. It is envisioned that the shield body 10 could also be sized to protect other digits, particularly thumbs and toes. It is envisioned that the shield body 10 sized for the toe would be smaller than the shield body 10 sized for the finger. In an additional embodiment, the shield body 10 is rectangular, with the first end 14 and the second end 15 each having a width of approximately 3 cm.

Figure 3:
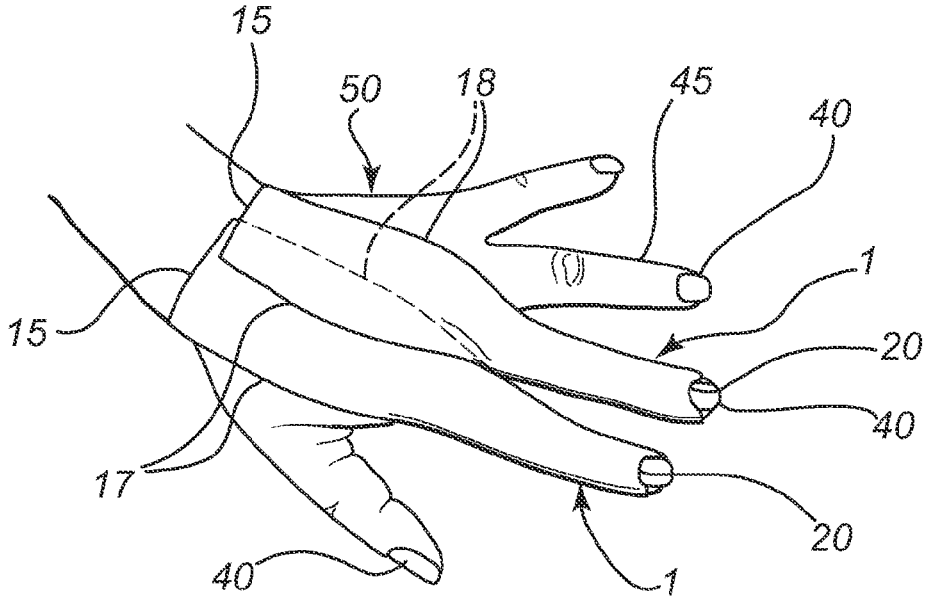
FIG. 3 is a back view of a hand with the protective shields located on the hand.

The first end 14 of the shield body 10 has a notched portion 20. Preferably, the notched portion 20 is an arcuate cut-out. The arcuate cut-out is shaped and sized to expose the nail 40 of a finger 45, as shown in FIG. 3. This enables UV radiation to be used to facilitate drying of nail polish on the exposed nail 40, whilst the skin of the finger 45 is protected from UV radiation exposure by the shield body 10.

The securing means 30 is comprised of adhesive tape 30. In the particular form illustrated in FIG. 2, two strips of adhesive tape 30 extend along adjacent opposing side 17 and 18 of the shield body 10. The strips of adhesive tape 30 extend along the shield body 10 to the first end 14 adjacent the notched portion 20. The adhesive tape 30 allows the sides of the finger 45 adjacent the nail 40 to be protected from UV radiation exposure whilst allowing the nail 40 of the finger 45 to be exposed to UV radiation. Further, the adhesive tape 30 is used to secure the shield body 10 to the finger 45 extends along the shield body 10. The adhesive tape 30 can be double sided adhesive tape 30. It is further envisioned that the securing means 30 could also be non-permanent glue, or some other type of temporary adhesive. For example, one side of the shield body 10 may be coated in a mineral oil gel or silicone gel, which has sufficient tackiness to enable the shield body 10 to adhere to the finger 45. In a preferred form, a moisturising and/or anti-aging agent is infused into the shield body 10. In a specific form, the gel may comprise a moisturiser, such as a botanical extract, for example, aloe vera and vitamin E. The gel may also or alternatively comprise photostable organic compounds, which increase the UPF of the shield body 10. The moisturiser diffuses into the skin when the shield body 10 is position on the finger 45, providing the skin with a moisturising treatment at the same time as protecting the skin from UV radiation exposure.

The protective shield 1 may also include a protective backing, such as a Mylar tape backing. The protective backing protects the gel from contamination before application to the finger 45.

A method of protecting skin on one or more digits of a person from UV exposure during the drying and hardening of nail polish includes the step of locating the shield body 10 on the digit, such as the finger 45, such that the notched portion 20 aligns with the nail 40 of the finger 45 and the notched portion 20 exposes the nail 40 of the finger 45. The shield body 10 extends along the finger 45 onto the hand 50, as shown in FIG. 3. The shield body 10 covers the skin of the finger 45 as the nail polish is being exposed to UV radiation.

Before locating the shield body 10 on the finger 45, a protective backing that has optionally been installed on the shield body 10 should be removed.

The method includes the further step of securing the shield body 10 to the finger 45 using the adhesive tape 30 or other securing means, as depicted in FIG. 3.

FIG. 3 shows the shield body 10 located on the hand of the person. The shield body 10 extends beyond the finger 45 onto the adjoining appendage, in this case a hand 50. In the case of using the shield body 10 to protect a toe, the adjoining appendage is a foot. The method can be repeated on or more fingers 45 of a hand, as illustrated in FIG. 3. When one or more further fingers 45 are covered, the second ends 15 of the shield bodies 10 overlap to form continuous protection against UV radiation on the back of the hand 50. The first end 14 is secured to the finger 45 adjacent to, and on opposing sides of, the notched portion 20 such that the nail 40 is exposed and the skin of the finger 45 is covered.

The protective shield 10 will be positioned on the finger 45 and/or hand 50 for a period of 15 to 20 minutes while under the UV lamp, to allow the nail polish to dry and harden. Once the nail polish is dry and hardened, and the hand or foot has been removed from the drying booth and UV lamp, the protective shield 10 is removed.

Figure 4:
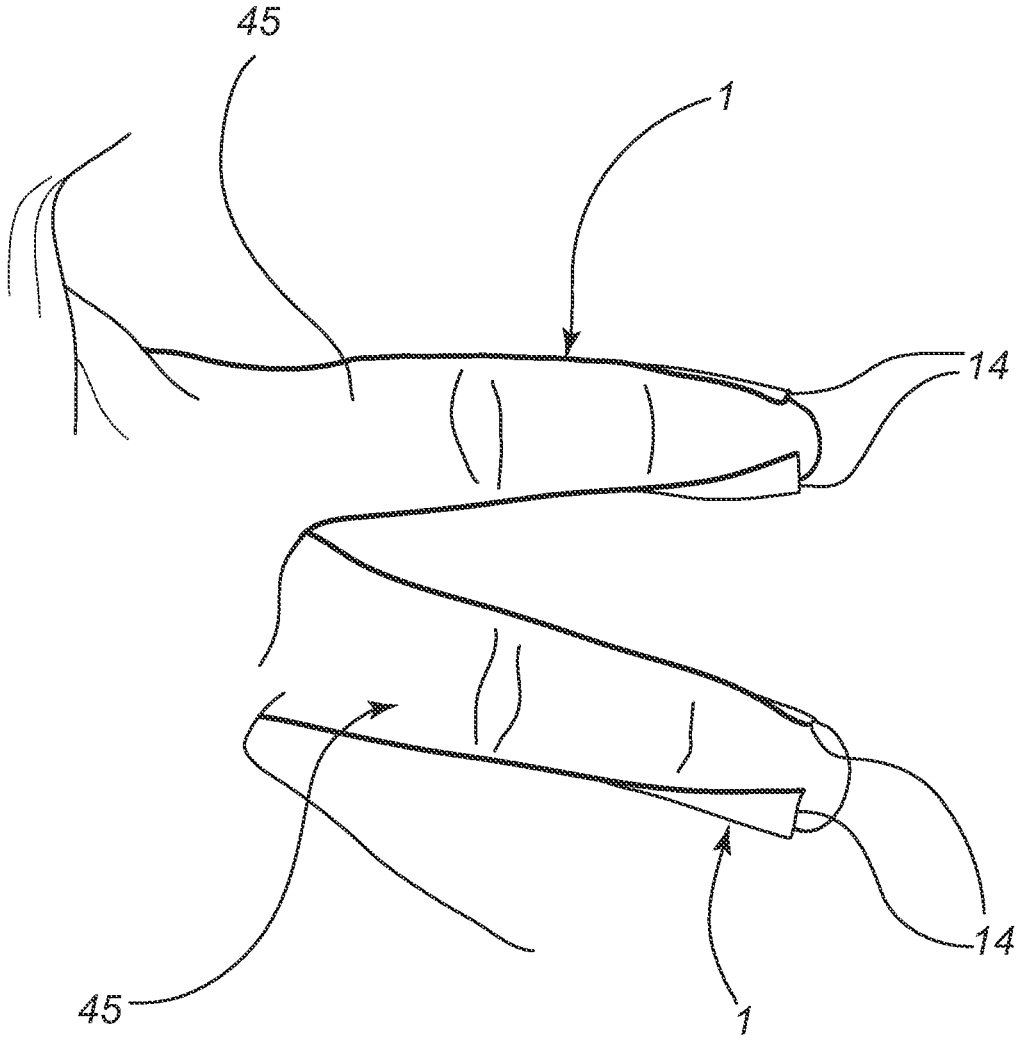
FIG. 4 is a front view of the hand of FIG. 3 with the protective shields located on the hand.

As illustrated in FIGS. 3 and 4, the shield body 10 conforms to the profile of the finger 45 to substantially cover the skin on the finger 45, whilst exposing the nail 40 of the finger 45 enabling UV radiation to be used to cure nail polish whilst the nail polish is drying.

The invention claimed is:

1. A protective shield for protecting skin on a digit of a person from UV radiation, said protective shield comprising:

a shield body that extends longitudinally from a first end to a second end of said shield body, said shield body comprising an elongate flexible UV resistant sheet material sized to substantially cover the skin on the back of the digit, said first end having a notched portion for exposing the nail of the digit; and a securing means for securing said shield body to the digit.

2. The protective shield of claim 1, wherein shield body tapers from said second end to said first end.

3. The protective shield of claim 1, wherein said notched portion comprises an arcuate cut-out.

4. The protective shield of claim 1, wherein said securing means comprises a gel that is infused into the shield body.

5. The protective shield of claim 1, wherein said securing means comprises adhesive tape.

6. The protective shield of claim 5, wherein said securing means includes two opposing strips of the adhesive tape that extend longitudinally along said shield body adjacent opposing sides of said shield body.

7. The protective shield of claim 6, wherein the strips of adhesive tape extend along said shield body to said first end adjacent said notched portion.

8. The protective shield of claim 1, wherein the flexible UV resistant sheet material comprises a non woven fabric.

9. The protective shield of claim 1, wherein a moisturising and/or anti-aging agent is infused into said shield body.

10. The protective shield of claim 1, wherein said shield body is sized to cover a finger.

11. The protective shield of claim 1, wherein said shield body is sized to cover a toe.

12. The protective shield of claim 1, wherein said shield body is sized to extend beyond the digit onto the adjoining appendage of the person.

13. A method of protecting skin on one or more digits of a person from UV exposure, said method including the steps of:

(a) locating the shield body of claim 1 on a digit of the person, such that the notched portion aligns with the nail of the digit and said shield body extends along the digit; and (b) securing the shield body to the digit using the securing means.

14. The method of claim 13, wherein the method further comprises repeating steps (a) and (b) in relation to one or more further digits of the person.

15. The method of claim 13, wherein said shield bodies extend beyond the digit onto the adjoining appendage with said second ends of the shield bodies overlapping to form continuous protection on the appendage.

16. The method of claim 13, wherein the digit is a finger and the appendage is a hand.

17. The method of claim 13, wherein the digit is a toe and the appendage is a foot.

* * * * *